United States Patent [19]

Lane

[11] 3,957,135

[45] May 18, 1976

[54] CLIMBING DEVICE

[76] Inventor: Henry G. Lane, 3816 Ave. O, NW., Winter Haven, Fla. 33880

[22] Filed: Apr. 8, 1975

[21] Appl. No.: 566,625

[52] U.S. Cl. ..... 182/136; 182/142

[51] Int. Cl.[2] ..... E04G 3/10

[58] Field of Search ..... 182/136, 133, 187, 188, 182/150, 142; 254/188

[56] References Cited

UNITED STATES PATENTS

| | | | |
|---|---|---|---|
| 335,278 | 2/1886 | Gadsby | 182/136 |
| 395,113 | 12/1888 | Batt | 254/188 |
| 2,847,059 | 8/1958 | Klins | 182/187 |

FOREIGN PATENTS OR APPLICATIONS

| | | | |
|---|---|---|---|
| 1,326,450 | 4/1963 | France | 182/187 |

*Primary Examiner*—Reinaldo P. Machado

[57] ABSTRACT

A device for climbing a tree, pole, or other vertically elongated generally cylindrical device is disclosed which comprises an operator's basket, a pair of identical hangers adapted to encompass the object to be climbed, and to be adjustably supported at selected elevations thereon, one above the other, and a block and tackle assembly which the operator connects between the uppermost hanger and the basket to move the basket with the operator therein relative to the uppermost hanger. The bottom hanger is used to support the basket in a fixed position while the upper hanger and upper block is repositioned further up the tree when climbing or further down the tree when descending. Alternate moving of the hangers, which alternately supporting the basket from one and then the other of the hangers, followed by raising or lowering the basket with the block and tackle assembly enables the operator to climb or descend the tree.

7 Claims, 6 Drawing Figures

FIG. 4
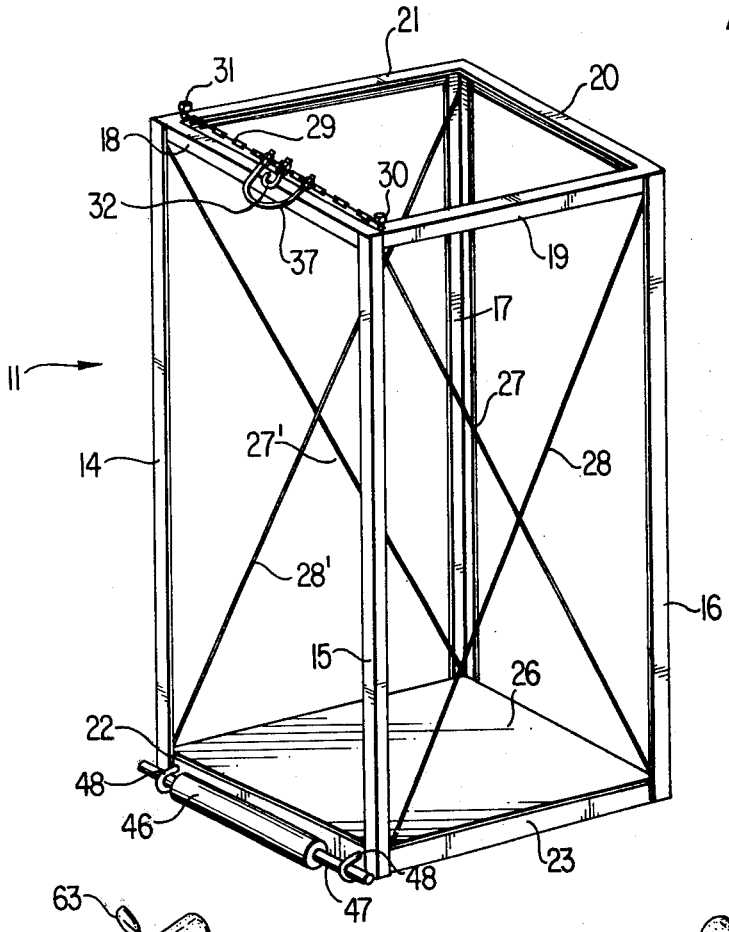
FIG. 5
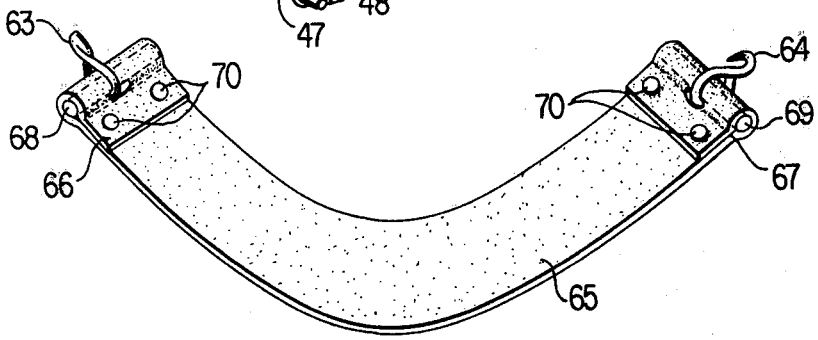
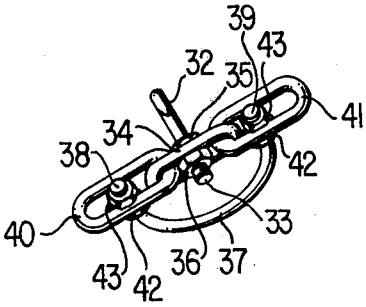
FIG. 6

CLIMBING DEVICE

BACKGROUND OF THE INVENTION

1. Field of the Invention

This invention relates to a tree or pole climbing device which enables an operator to ascend or descend a tree under his own power.

2. Description of the Prior Art

Various devices for climbing a tree, pole, or other generally cylindrical object are known in the prior art. The following Pat. Nos. are representative:

| | | |
|---|---|---|
| 755,809 | Stoolfire | Mar. 29, 1904 |
| 1,153,583 | Stoolfire | Sept. 14, 1915 |
| 2,311,352 | Seiler | Feb. 16, 1943 |
| 3,417,841 | Lebre | Dec. 24, 1968 |
| 3,485,320 | Jones | Dec. 23, 1969 |

The devices disclosed by the above patents are structurally substantially different from the present invention.

SUMMARY OF THE INVENTION

This invention relates to an improved device for climbing trees, poles, and like generally cylindrical objects which comprises an operator's basket in which an operator stands, a pair of hangers for encompassing a tree or pole at selected elevations along the tree or pole and which normally grip the tree or pole, and a block and tackle assemly engageable between the uppermost of the hangers and the basket by which the operator raises or lowers the basket relative to the hanger.

It is an object of this invention to provide an improved tree and pole climbing apparatus which includes novel flexible hangers for encompassing and gripping a tree, pole or other like generally cylindrical objects and providing support for the operator's basket at selected positions along the length of the tree, pole or other like generally cylindrical object, the hangers being slidably manipulatable by the operator along the length of the tree.

It is another object of the invention to provide an improved tree and pole climbing device which includes an open framework box-like basket for supporting an operator during ascent or descent of the tree, pole or like generally cylindrical object, the basket having a roller mounted along its bottom front edge providing an antifriction bearing between the basket and the object being climbed or descended.

BRIEF DESCRIPTION OF THE DRAWINGS

With the foregoing objects and features in view and such other objects and features which may become apparent as this specification proceeds, the invention will be understood from the foregoing description taken in conjunction with the accompanying drawings, wherein like characters of reference designate like parts and wherein:

FIG. 4 is a perspective view of the operator's support basket forming part of the invention;

FIG. 5 is a perspective view of the belt portion of one of the two identical hangers.

FIG. 6 is an enlarged perspective view showing the center portion of the basket support chain with attached hook and U-bolt shown in FIG. 4. Referring now to the drawings, the climbing device 10 comprises a basket 11 for supporting a human operator, a pair of identical hangers 12, 12' embracing an object to be climbed, such as a tree T (as shown), pole or other elongated generally cylindrical device, at different levels, and a block and tackle assembly 13 which the operator engages between the basket and one of the hangers 12, 12' to raise or lower the basket.

Figure 2:
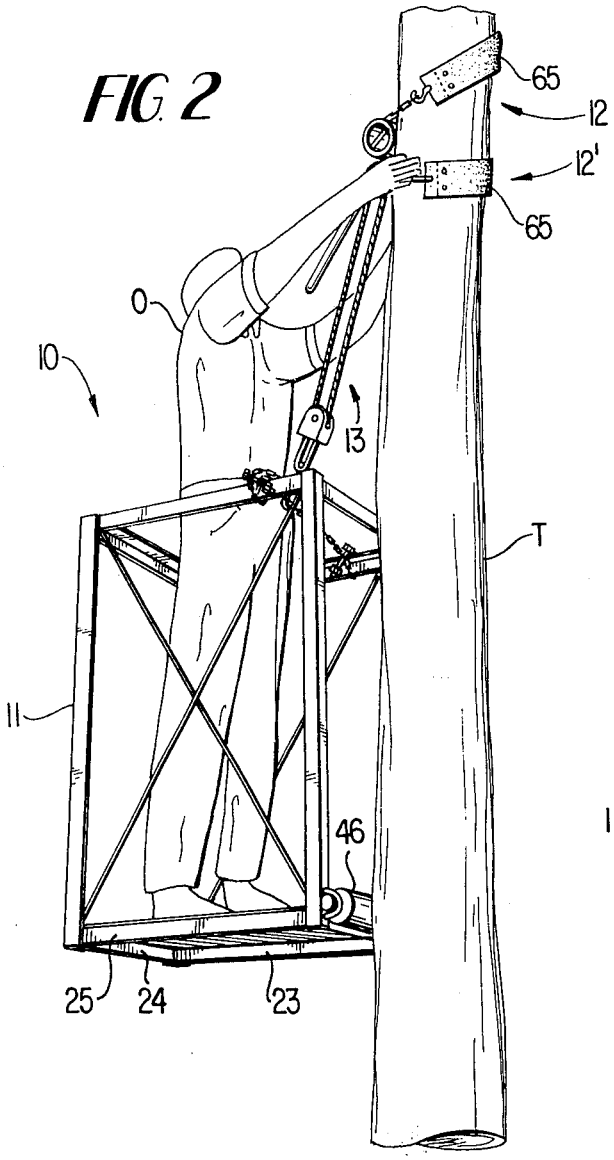
FIG. 2 is a perspective view of the invention attached to a pole and showing an operator manipulating one of the hangers.

The basket 11 (see FIG. 4) includes a skeleton box frame work comprising four vertical corner posts 14, 15, 16 and 17; four interconnecting top, horizontal frame elements 18, 19, 20 and 21; four interconnecting bottom, horizontal frame elements 22, 23, 24, and 25; a light sheet metal floor 26 secured to the top side of the bottom frame elements; and two sets of crossed steel braces 27, 28, and 27', 28', each connecting opposite top and bottom corners on opposite sides of the basket frame to add rigidity thereto. The frame elements 14–25 inclusive are preferrably light angle iron bars, but other lightweight rigid materials of suitable strength may be substituted. A length of chain 29 is connected across the top of the basket 11 by bolts 30, 31, extending through opposite end links of the chain and opposite frame elements 19 and 21 respectively.

A hook 32 having a threaded shank 33 which extends through the center link 34 of the chain 29 is clamped to the link 34 by means of nuts 35, 36 screwed onto the shank on opposite sides of the link. A U-bolt 37 is secured to the chain links 40, 41 on opposite sides of the center link 34 by passing the threaded ends 38,39 of the U-bolt through the links 40,41 and clamping them to the links by means of nuts 42,43 screwed onto the threaded ends on opposite sides of the links. A hollow roller 46 mounted on a shaft 47 is provided adjacent the bottom front side of the basket 11 to space the bottom of the basket from the tree to which it is attached and to provide anti-friction means facilitating the movement of the basket up and down the tree. The shaft 47 is of greater length than the roller 46 so that its opposite ends extend outwardly from the ends of the roller 46. U-bolts 48,48 on each end of the shaft 47 clamp the shaft to the bottom frame element 22.

The identical hangers 12,12' each comprise a belt 65 with hooks 63 and 64 at opposite ends; a piece of pipe 50; an eye bolt 51 passed transversely through aligned holes bored transversely through the middle of the pipe and secured therein by a nut 51' on the opposite side of the eye; a chain 52 extending through the eye bolt 51 and along the length of the pipe to adjacent its opposite ends where transverse bolts 55 and 56 pass through the end portions 53 and 54 of the pipe and links of the chain 52 to secure the chain thereto. The opposite end portions of the chain 52 extending beyond the bolts 55,56 are wrapped completely around the pipe end portions 53,54 respectively providing pipe encircling portions 57 and 59 and remaining free end portions 58 and 60. The pipe encircling portions 57,59 are secured to the remaining free end portions 58,60 respectively by bolts 61,62 extending through adjacent links in the chain. The free end portions are of suitable length to extend partially around a tree, pole, or like object when the pipe is placed horizontally against one side of the object inorder that hooks 63 and 64 affixed to opposite ends of belt 65 on the opposite side of the object from the pipe may engage in selected links of the free end portions to secure the hangers 12,12' to the object. When the free end portions of the chain are of sufficient length to accommodate the largest object for which the climbing device of this invention is designed to be used, the hangers 12, 12' may be adjusted to fit different size objects by selectively engaging the hooks 63 and 64 with different links in the free end portions 58 and 60 to provide the desired tautness in the hanger. The hangers 12,12' will normally be allowed sufficient slack so that the hangers may be manipulated up or down the object. The pipe 50 will normally sag downwardly relative to the belt 65. However, a downward force applied to the pipe through the eye bolt 51 will tighten the hanger against the object T and prevent slipping of the hanger relative to the object.

By way of illustration only, the pipe 50 may be two-inch diameter pipe about seven inches long, and the belt may be approximately five inches wide and about two feet long. The belt 65 is of non-stretchable belting material and its opposite ends are folded back upon the main body of the belt to form tubular hems which tightly encompass pieces of pipe of the same length as the belt is wide. The folded over ends 66 and 67 are secured tightly around the pipes 68 and 69 respectively by suitable fasteners 70 such as bolts or rivets. The large S-shaped hooks 63,64 each have one of their bights extended through a hole provided in the belt and around one of the pipes 68,69 which function as reinforcement for the belting and a pivot pin for the hooks to keep the hooks from tearing out of the belting.

The block and tackle assembly 13 comprises upper and lower blocks $B_1$ and $B_2$ respectively and interconnecting rope 74, one end of which is secured to the upper block while the remainder of the rope is rove alternately through the blocks $B_2$ and $B_1$ around the sheaves thereof leaving a free end 74'. Each block has a yoke 76 to which is secured a hook 77. In use the hook of the block $B_1$ will be engaged with the eye-bolt 51 of the uppermost hanger 12 and the hook of the lower block $B_2$ will be engaged with the U-bolt 37 on the chain 29 at the top of the basket 11. An operator in the basket 11 by pulling on the free end 74' of the rope 74, or allowing the free end to play through the blocks, may raise or lower the basket relative to hanger 12. Preferably the block and tackle assembly 13 includes an automatic lock on one of the blocks which permits unrestricted movement of the rope 74 when the operator pulls on the rope but grips the rope when the movement of the rope is reversed. One such block and tackle assembly of the self-locking type is disclosed in U.S. Pat. No. 1,870,992. Others are known and are commercially available. Release of the lock inorder to permit reverse movement of the rope is usually accomplished by manual operation of a release lever or pull cord which disengages grippers from contact with the rope. In the present embodiment the upper block $B_1$ includes automatic locking means (not shown) which is released by the release lever 75.

Operation of the Invention

Figure 1:
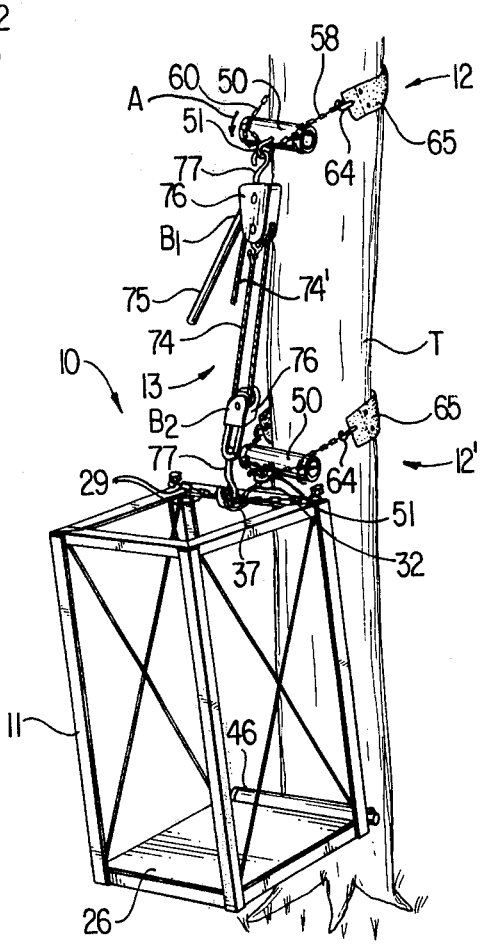
FIG. 1 is a perspective view of the invention attached to a pole in a position for an operator to enter.
Figure 3:
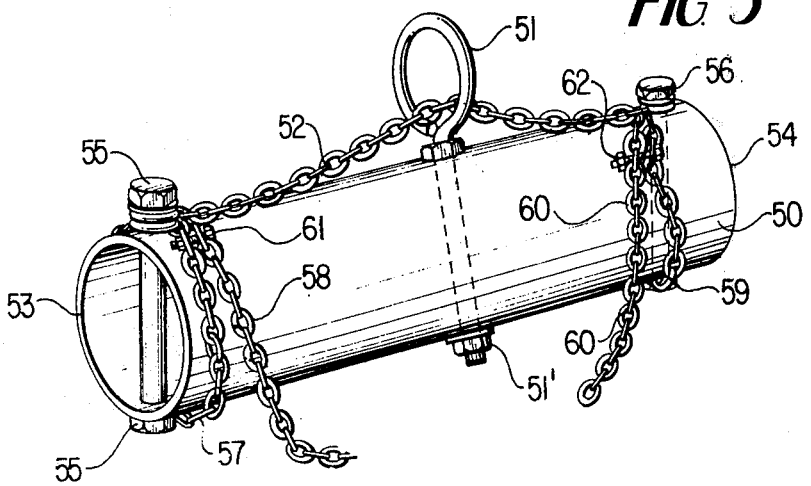
FIG. 3 is a perspective view of a portion of one of the two identical hangers.

In use the operator O will first attach the hangers 12 and 12' to the object to be climbed, the lower hanger being positioned a distance above the bottom of the object (a tree being shown in FIGS. 1 & 2) somewhat greater than the height of the basket 11. The operator then attaches the basket 11 to the lower hanger 12' by engaging the hook 32 (which is affixed to the chain 29 across the top of the basket) with the eye-bolt 51 affixed to the hanger pipe 50. The basket then hangs as shown in FIG. 1 a short distance above the bottom of the tree T. The operator then enters the basket through the open side opposite the tree and stands on the basket floor. He then grasps the upper hanger 12 and slides it up the tree as far as he can reach and releases the hanger. The weight of the pipe 50 pulling down on the belt 65 draws the belt tight against the tree T and the friction there between keeps the hanger in position. The greater the weight attached to the hanger pipe 50, the greater will be the frictional forces holding the hanger in position. The operator O then connects the hook 77 of the upper block $B_1$ to the eye-bolt 51 of the upper hanger 12 and attaches the hook 77 of the lower block $B_2$ to the U-bolt 37 affixed to the chain 29 across the top of the basket 11. The upper block $B_1$ being a self locking block will hold the basket from the upper hanger once the rope 74 between the upper and lower blocks is tightened by the operator pulling on the free end 74' of the rope. The operator then releases his grasp on the rope 74', unhooks the lower hanger pipe 50 from the hook 32, and slides the lower hanger 12' up the tree to a position adjacent the upper hanger 12, as shown in FIG. 2. The operator then grasps the end of rope 74', releases the lock on the upper block $B_1$ by operating the release lever 75, and pulls the rope 74 until the basket is raised to a position adjacent the lower hanger 12' whereupon the operator releases the rope end 74' and the upper block $B_1$ automatically locks holding the basket in stationary position. The operator then attaches the hook 32 at the top of the basket to the eye bolt 51 of the lower hanger pipe 50 and releases the lock on the block $B_1$ so that the weight of the basket 11 and its contents is shifted from the block and tackle assembly 13 to the lower hanger 12'. The operator, if he wishes to climb higher, will then repeat the sequence of steps just described as often as necessary to reach the desired height.

When descending the process is generally reversed, alternately shifting the weight of the basket from one hanger to the other, lowering the basket by the block and tackle assembly and alternately manipulating the hangers to slide them down the object.

It will be observed that (looking at FIG. 1) a downward force applied to the eye bolt 51 of one of the hanger pipes 50 will cause the pipe 50 to rotate downwardly relative to the object T as indicated by the arrow A. Rotation of the pipe 50 in the manner described tends to wrap the chains 58 and 60 about the pipe 50 thereby exerting substantial horizontal force components throught the chains 58 and 60 which draw the belt 65 tight against the object T. By the aforesaid arrangement, the force tightening the belt 65 against the object increases with an increase in the downward force applied to the eyebolt 51.

Also it will be observed that the basket 11 tends to pivot outwardly relative to the object T about the roller 46 at the bottom of the basket. Outward pivoting of the top of the basket 11 relative to the tree will exert an outwardly directed force through the hook 32, the eye bolt 51, pipe 50 and chains 58 and 60 of the lower hanger 12' which draws the belt 65 tight against the object T. Since an operator will normally stand on the floor 26 some distance from the roller 46, the force moment resulting from the operator's weight and the distance the operator stands from the roller 46 will cause a resulting outwardly directed force on the hanger 12' because of the pivoting of the basket relative to the roller 46 which will be substantial.

The blocks $B_1$ and $B_2$ can be selected to have any number of sheeves depending upon the desired mechanical advantage which is required to enable an operator to easily lift the basket and operator relative to the hanger 12.

While in the foregoing there has been described and illustrated a preferred embodiment of the invention, various modifications and equivalents may be resorted to within the spirit and scope of the invention as claimed.

What is claimed is:

1. A device for climbing a tree, pole or other vertically elongated generally cylindrical object, comprising basket means for supporting a human operator, a pair of flexible hangers for encompassing and gripping the object being climbed, and a block and tackle assembly means engageable between one of the hangers and the basket means for use by the operator to lift the basket and operator, said basket means having connecting means for selectively supporting said basket means alternately from the one of said hangers through said block and tackle assembly and from the other of said hangers independent of said block and tackle assembly, said hangers each comprising an elongated roller having a pair of opposite ends, a rigid loop projecting radially from said roller intermediate the opposite ends thereof, friction belt means for partially encompassing said object and being frictionally retained thereon against sliding when tightened against said object, said belt means having a pair of ends and fastener means secured to each of said ends, and a pair of flexible connectors of selected length, each flexible connector having an end affixed to said roller and a free end extending loosely from said roller, one connector being affixed to said roller on one side of said rigid loop and the other flexible connector being affixed on the other side of said loop, said fastener means at the ends of said belt, each being separably connectable with one of said flexible connectors at a selected position along the length thereof so that said hanger may be adjusted to closely encompass objects to be climbed which are of different diameters by selecting the position along the length of said flexible connectors to which said fasteners are separably connected.

2. The device according to claim 1 wherein said flexible connectors are each a length of link chain, and said fastener means are hooks, said hooks being separably connectable with selected links of said lengths of chain.

3. The device according to claim 1 wherein the ends of said flexible connectors which are fixed to said roller are connected to the same side of said roller from which said loop projects, so that when said roller is placed against one of said objects to be climbed with its longitudinal axis approximately horizontal and with the loop projecting away from the object and said flexible connectors are positioned over the roller and connected with said fastener means to close said hanger closely about the object, the weight of the basket when applied to said loop will cause said roller to roll downwardly relative to said object and wrap said flexible connectors on said roller, thereby tightening said hanger about said object and restraining movement of said hanger relative to said object.

4. The device according to claim 1 wherein said block and tackle assembly includes an upper block, a lower block and rope interconnecting said upper and lower blocks, said rope having one end secured to one of said blocks and a free-end adapted to be grasped by an operator inorder for the operator to draw the blocks closer together or to permit the blocks to move further apart, said blocks each having hooks whereby the upper block is connectable to said one hanger and the lower block is connectable to said connecting means.

5. The device according to claim 4 wherein one of said blocks is self locking to restrain motion of said rope in one direction, and has a manually controlled release actuator for releasing said rope to move freely.

6. A device for climbing a tree, pole or other vertically elongated generally cylindrical object, comprising basket means for supporting a human operator, a pair of flexible hangers for encompassing and gripping the object being climbed, and a block and tackle assembly means engageable between one of the hangers and the basket means for use by the operator to lift the basket and operator, said basket means having connected means for selectively supporting said basket means alternately from the one of said hangers through said block and tackle assembly and from the other of said hangers independent of said block and tackle assembly, said connecting means comprises a chain connected across the top of said basket, a hook, and a loop both connected to and projecting from said chain near a midpoint of said chain, said hook being connectable directly to said other hanger to support said basket independent of said block and tackle assembly and said loop being connectable with said block and tackle assembly to support said basket from one said one hanger through said block and tackle assembly.

7. A device for climbing a tree, pole or other vertically elongated generally cylindrical object, comprising basket means for supporting a human operator, a pair of flexible hangers for encompassing and gripping the object being climbed, and a block and tackle assembly means engageable between one of the hangers and the basket means for use by the operator to lift the basket and operator, said basket means for use by the operator to lift the basket and operator, said basket means having connecting means for selectively supporting said basket means alternately from the one of said hangers through said block and tackle assembly and from the other of said hangers independent of said block and tackle assembly, together with roller means mounted on said basket means for providing an antifriction bearing surface to space said basket from the object to be climbed, said basket comprising an open top, a bottom covered by a floor, a front, a back and a pair of opposite sides, said roller means being mounted across said front adjacent the bottom of said basket, said connecting means comprising a chain having opposite ends connected to opposite sides of said basket adjacent the front thereof, a hook and a loop connected to and projecting from said chain near the midpoint of said chain.

* * * * *